US008247748B2

(12) United States Patent
Watanabe et al.

(10) Patent No.: US 8,247,748 B2
(45) Date of Patent: Aug. 21, 2012

(54) INDUCTION HEATING COOKER

(75) Inventors: Kenji Watanabe, Hyogo (JP); Izuo Hirota, Hyogo (JP); Hiroshi Tominaga, Hyogo (JP); Tomoya Fujinami, Shiga (JP); Keiko Isoda, Hyogo (JP)

(73) Assignee: Panasonic Corporation, Osaka (JP)

( * ) Notice: Subject to any disclaimer, the term of this patent is extended or adjusted under 35 U.S.C. 154(b) by 387 days.

(21) Appl. No.: 12/665,981

(22) PCT Filed: Jun. 23, 2008

(86) PCT No.: PCT/JP2008/001621

§ 371 (c)(1),
(2), (4) Date: Dec. 22, 2009

(87) PCT Pub. No.: WO2008/155923

PCT Pub. Date: Dec. 24, 2008

(65) Prior Publication Data

US 2010/0176120 A1 Jul. 15, 2010

(30) Foreign Application Priority Data

Jun. 21, 2007 (JP) ..... 2007-163503
Aug. 13, 2007 (JP) ..... 2007-210759

(51) Int. Cl.
*H05B 6/12* (2006.01)

(52) U.S. Cl. ..... 219/627; 219/620; 219/622

(58) Field of Classification Search ..... 219/620, 219/622, 624, 627, 661, 667, 663, 664
See application file for complete search history.

(56) References Cited

U.S. PATENT DOCUMENTS 4,013,859 A * 3/1977 Peters, Jr. ..... 219/626
2003/0047559 A1 3/2003 Watanabe et al.
2006/0081607 A1 4/2006 Niiyama et al.

FOREIGN PATENT DOCUMENTS

JP 64-033881 2/1989
JP 5-21149 1/1993

(Continued)

OTHER PUBLICATIONS

International Search Report issued Sep. 16, 2008 in International (PCT) Application No. PCT/JP2008/001621.

(Continued)

*Primary Examiner* — Henry Yuen
*Assistant Examiner* — Hung D Nguyen
(74) *Attorney, Agent, or Firm* — Wenderoth, Lind & Ponack, LLP.

(57) ABSTRACT

An induction heating cooker includes a cooking container heating coil, an inverter circuit to supply high-frequency current to the heating coil, an infrared ray sensor to detect radiation from the container, an electric power integrating section to integrate heating electric power from the inverter circuit, and a heating control section to control an inverter circuit output. If the power integrating section has less than a predetermined value when an increase in the output of the infrared ray sensor has a first value after start of heating, the cooker shifts to a first heating control mode and, if equal to or more than the predetermined value, shifts to a second heating control mode. The power, in the first heating control mode, is reduced to a second amount of power lower than the first amount and, in the second heating control mode, is a third amount larger than the second amount.

7 Claims, 11 Drawing Sheets

FOREIGN PATENT DOCUMENTS

| | | |
|---|---|---|
| JP | 2003-317918 | 11/2003 |
| JP | 2004-227816 | 8/2004 |
| JP | 2004-327053 | 11/2004 |
| JP | 2005-347000 | 12/2005 |
| JP | 2006-040778 | 2/2006 |
| JP | 2006-344456 | 12/2006 |

OTHER PUBLICATIONS

English translation of International Preliminary Report on Patentability and Written Opinion of the International Searching Authority, issued Jan. 12, 2010, in PCT/JP2008/001621.

Supplemental European Search Report, issued Aug. 8, 2011 in EP application 08827475.08, which is a counterpart to the present application.

* cited by examiner

TEMPERATURE OF COOKING CONTAINER
t1
TIME

AMOUNT OF INCREASE IN OUTPUT OF INFRARED RAY SENSOR
V1
t1
t3
t5
TIME

AMOUNT OF HEATING ELECTRIC POWER
P1
P2
T1
T1
T1
0
t1
t2
t3
t4
t5
TIME

INTEGRATED AMOUNT OF ELECTRIC POWER
Wh1
0
t1
TIME
INITIAL CONTROL MODE
FIRST HEATING CONTROL MODE

TEMPERATURE OF COOKING CONTAINER
t1
TIME

AMOUNT OF INCREASE IN OUTPUT OF INFRARED RAY SENSOR
V2
V1
t1
t2
t3
TIME

AMOUNT OF HEATING ELECTRIC POWER
P1
P2
0
t1
t2
t3
TIME

INTEGRATED AMOUNT OF ELECTRIC POWER
Wh1
0
t1
TIME
INITIAL CONTROL MODE
SECOND HEATING CONTROL MODE

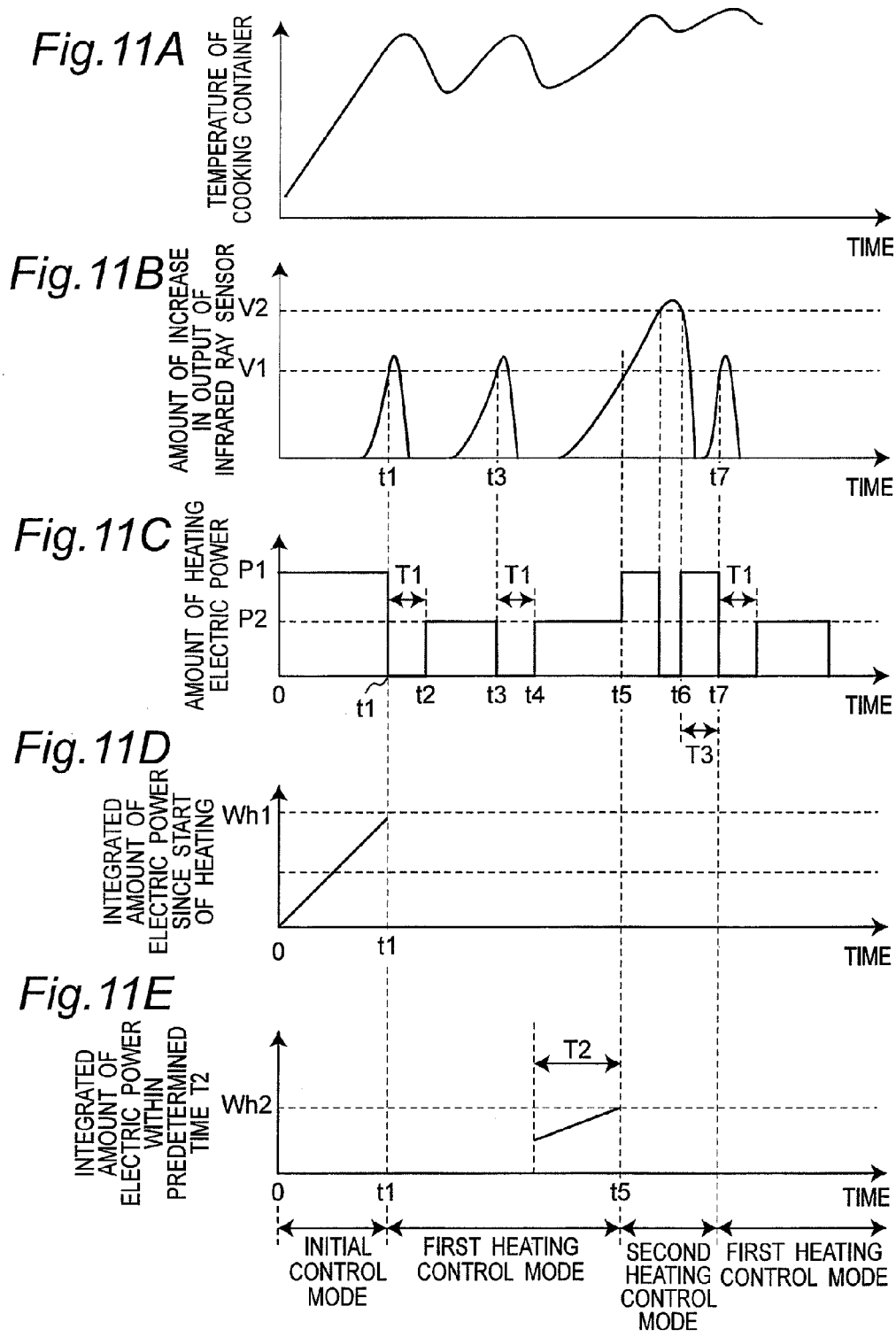
Fig.11A
TEMPERATURE OF COOKING CONTAINER
TIME
Fig.11B
AMOUNT OF INCREASE IN OUTPUT OF INFRARED RAY SENSOR
V2
V1
t1
t3
t7
TIME
Fig.11C
AMOUNT OF HEATING ELECTRIC POWER
P1
P2
T1
T1
T1
0
t1
t2
t3
t4
t5
t6
t7
T3
TIME
Fig.11D
INTEGRATED AMOUNT OF ELECTRIC POWER SINCE START OF HEATING
Wh1
0
t1
TIME
Fig.11E
INTEGRATED AMOUNT OF ELECTRIC POWER WITHIN PREDETERMINED TIME T2
T2
Wh2
0
t1
t5
TIME
INITIAL CONTROL MODE
FIRST HEATING CONTROL MODE
SECOND HEATING CONTROL MODE
FIRST HEATING CONTROL MODE

INDUCTION HEATING COOKER

BACKGROUND OF THE INVENTION

1. Technical Field

The present invention relates to an induction heating cooker operable to perform induction heating of a cooking container.

2. Background Art

In recent years, an induction heating cooker which performs induction heating of cooking containers with a heating coil, such as pans and frying pans, has been widely used in ordinary households and business kitchens. An induction heating cooker detects a temperature of a bottom surface of a cooking container and controls a heating coil such that the detected temperature is coincident with a set temperature.

For example, JP-A-64-33881 (patent document 1) describes an induction heating cooker which is provided with a temperature detection section at a predetermined position on a lower surface of a top plate in order to detect the temperature of the bottom surface of the cooking container. The induction heating cooker starts heating with a predetermined amount of heating electric power at first, and then temporarily stops the heating if a temperature gradient in the bottom surface of the cooking container exceeds a predetermined temperature gradient. Thereafter, heating is restarted by reducing an amount of heating output by half. After heating is restarted, if the detected temperature exceeds a set temperature, the heating is stopped, and if the detected temperature becomes lower than the set temperature, the heating is restarted, so that the temperature of the cooking container is maintained at the set temperature.

However, in cases where the temperature detection section detects the temperature of a cooking container by detecting the temperature at a predetermined position on a lower surface of a top plate, as in the induction heating cooker in the patent document 1, there have been cases where the temperature detected by the temperature detection section is different from the actual temperature gradient in the cooking container or temporarily cannot follow the actual temperature of the cooking container.

For example, when a pan is heated in an empty state at the start of heating, a large temperature gradient actually occurs. However, when the bottom of the pan is warped in a convex shape and there is a large gap between the pan bottom surface and the top plate, the temperature of the pan cannot be easily transferred to the top plate, thereby causing a smaller temperature gradient to be detected. Therefore, the heating is tardily stopped, thereby inducing the problem that the temperature of the pan reaches a high temperature.

Further, when the pan bottom has a small thickness, the temperature of the pan bottom rapidly rises. However, even if the temperature of the pan bottom rapidly rises, since time is required for transferring heat to the bottom surface of the top plate, the temperature detected by the temperature detection section temporarily cannot follow the actual temperature. Therefore, there have been cases where, even when the temperature gradient can be properly determined, the determination is temporarily delayed. As a result, the heating is tardily stopped, thereby inducing the problem that the temperature of the pan bottom reaches a high temperature.

As described above, conventional induction heating cookers have induced the problem that pans having pan bottoms warped in convex shapes and pans having pan bottoms with small thicknesses are excessively heated, thereby preventing heating with high efficiency.

SUMMARY OF THE INVENTION

The present invention has been made in order to solve the aforementioned problems in the related art and aims at providing an induction heating cooker capable of preventing pans having pan bottoms warped in convex shapes and pans having pan bottoms with small thicknesses from being excessively heated, thereby enabling heating with high efficiency.

An induction heating cooker of the present invention includes: a top plate made of a material capable of transmitting an infrared ray; a heating coil operable to perform induction heating of a cooking container placed on the top plate with a supplied high-frequency current; an inverter circuit operable to supply a high-frequency current to the heating coil; an infrared ray sensor including an amplifier and being operable to detect an infrared ray which is radiated from a bottom surface of the cooking container and passes through the top plate and to output a detection signal corresponding to a temperature of the bottom surface of the cooking container; an electric power integrating section operable to integrate an amount of heating electric power outputted from the inverter circuit; and a heating control section operable to control the high-frequency current outputted from the inverter circuit based on an output of the infrared ray sensor and an output of the electric power integrating section. The infrared ray sensor has an amplification factor of the amplifier which is set in such manner that magnitude of the detection signal is nearly constant until the temperature of the bottom surface of the cooking container reaches a predetermined temperature and the magnitude of the detection signal increases exponentially after the temperature of the bottom surface of the cooking container exceeds the predetermined temperature. The heating control section determines whether or not an integrated value from the electric power integrating section is less than a first predetermined amount of electric power, when an amount of increase in an output of the infrared ray sensor on the basis of an output value of the infrared ray sensor at a start of heating with a first amount of heating electric power has reached a first predetermined value, when the integrated value from the electric power integrating section is less than the first predetermined amount of electric power, the heating control section shifts to a first heating control mode for limiting the amount of heating electric power to a second amount of heating electric power lower than the first amount of heating electric power, and when the integrated value from the electric power integrating section is equal to or more than the first predetermined amount of electric power, the heating control section shifts to a second heating control mode for heating with a third amount of heating electric power larger than the second amount of heating electric power.

Infrared rays radiated from the bottom surface of the cooking container are detected using the infrared ray sensor to directly detect the temperature of the bottom surface of the cooking container. Therefore, even when the bottom surface of the cooking container is warped in a convex shape and there is a gap between the cooking container and the top plate, it is possible to detect the temperature of the cooking container with high accuracy by following the actual temperature gradient in the cooking container, without being influenced by the gap. Further, even when the bottom surface of the cooking container has a small thickness and the temperature of the cooking container rapidly rises, it is possible to detect the temperature by following the rapid temperature rise without inducing a time delay.

During the first heating control mode, the heating control section may repeat control to increase the amount of heating electric power to perform heating with the second amount of heating electric power after elapse of a first predetermined time from stopping or limiting of the heating and control to stop or limit the heating when the amount of increase in the output value of the infrared ray sensor reaches a second predetermined value.

The induction heating cooker integrates the amount of electric power outputted from the inverter circuit until a predetermined temperature is reached after the start of heating, and if the integrated amount of electric power is lower than a predetermined value, heating is performed with reduced heating power, and also the threshold value for the infrared ray sensor for stopping or limiting the heating is lowered. Accordingly, even when the bottom surface of the cooking container has a small thickness or the cooking container is heated in an empty state, it is possible to prevent the cooking container from being excessively heated. On the contrary, when the cooking container has a large thickness or when the cooking container has a large thermal capacity, such as when the cooking container contains liquid and vegetables therein, it is possible to increase the amount of heating electric power for immediately raising the temperature of the cooking container, in comparison with cases where the bottom surface of the cooking container has a small thickness or the cooking container is heated in an empty state.

The second predetermined value may be equal to or larger than the first predetermined value.

During the second heating control mode, the heating control section may repeat control to stop the heating when the amount of increase in the output value of the infrared ray sensor reaches a third predetermined value larger than the second predetermined value and control to perform the heating with the third amount of heating electric power when the amount of increase in the output value of the infrared ray sensor decreases below the third predetermined value.

In the second heating control mode, heating is performed with higher heating power, and also the threshold value for the infrared ray sensor for stopping or limiting the heating is further heightened, in comparison to the first heating control mode. Accordingly, when the bottom surface of the cooking container has a large thickness or the cooking container contains ingredients, it is possible to sufficiently heat the cooking container.

The heating control section may shift from the first heating control mode to the second heating control mode when the integrated value of the amount of heating electric power within a second predetermined time during a heating operation in the first heating control mode exceeds a second amount of heating electric power.

Accordingly, it is possible to perform temperature control suitable for cooking methods including transitions from a preheating processing for heating only oil to a heating processing for introducing and sautéing ingredients. In other words, it is possible to lower the heating power for preventing excessive heating at a state where the cooking container contains only oil, and it is possible to change the heating power to higher heating power after ingredients are introduced, thereby enabling sufficient heating.

The heating control section may shift to the first heating control mode from the second heating control mode when a time required for the amount of increase in the output value of the infrared ray sensor to reach the first predetermined value after the start of heating with the first amount of heating electric power is equal to or less than a third predetermined time during a heating operation in the second heating control mode.

Accordingly, it is possible to perform temperature control suitable for cases where the state is changed from a state where ingredients are heated to a state where the ingredients have been removed. That is, at a state where the cooking container contains ingredients, it is possible to perform sufficient heating with higher heating power, and after the ingredients are removed, it is possible to change the heating power to lower heating power, thereby preventing the cooking container from being excessively heated.

The infrared ray sensor may be placed halfway in a radial direction of the heating coil.

The position halfway in a radial direction of the heating coil strongly experiences the high-frequency magnetic field, which enables detecting a substantially highest temperature in the bottom surface of the cooking container. Accordingly, it is possible to control the amount of the heating electric power based on the substantially highest temperature in the cooking container, thereby preventing excessive heating.

According to the present invention, the temperature of the cooking container is detected with excellent accuracy by using a method in which the infrared ray sensor detects infrared rays radiated from the cooking container without being easily influenced by ambient light and emissivity, and also the integrated electric power is determined at the same time to estimate the thermal capacity of the cooking container for controlling the amount of heating electric power. Therefore, even when the bottom surface of the cooking container is warped in a convex shape and there is a gap between the cooking container and the top plate, it is possible to control the temperature of the cooking container with excellent responsivity by following the temperature gradient in the cooking container without being influenced by the gap. In other words, it is possible to properly increase and decrease the amount of heating electric power according to the state of the cooking container to raise the temperature of the cooking container while following the rapid temperature rise in the cooking container, without inducing a time delay, thereby controlling the temperature of the cooking container, by distinguishing between cases where the bottom surface of the cooking container has a small thickness and the temperature of the cooking container rapidly rises and cases where the bottom surface of the cooking container has a large thickness or the cooking container has a large thermal capacity such as cases where the cooking container contains objects to be heated such as vegetables and requires high heating electric power. Accordingly, it is possible to immediately raise the temperature of the cooking container to a high temperature with high heating electric power, and also it is possible to prevent excessive heating of pans having pan bottoms warped in convex shapes and pans having pan bottoms with small thicknesses.

BRIEF DESCRIPTION OF THE DRAWINGS

FIGS. 6A, 6B, 6C, and 6D are waveform diagrams in the initial control mode and in the first heating control mode according to the first embodiment of the present invention, wherein FIG. 6A illustrates a temperature of a cooking container, FIG. 6B illustrates an amount of increase in an output of the infrared ray sensor, FIG. 6C illustrates an amount of heating electric power, and FIG. 6D illustrates an integrated amount of electric power.

FIGS. 8A, 8B, 8C and 8D are waveform diagrams in the initial control mode and in the second heating control mode according to the first embodiment of the present invention, wherein FIG. 8A illustrates a temperature of a cooking container, FIG. 8B illustrates an amount of increase in an output of the infrared ray sensor, FIG. 8C illustrates an amount of heating electric power, and FIG. 8D illustrates an integrated amount of electric power.

FIGS. 11A, 11B, 11C, 11D and 11E are waveform diagrams in the initial control mode, in the first heating control mode, and in the second heating control mode according to the second embodiment of the present invention, wherein FIG. 11A illustrates a temperature of a cooking container, FIG. 11B illustrates an amount of increase in an output of the infrared ray sensor, FIG. 11C illustrates an amount of heating electric power, FIG. 11D illustrates an amount of electric power which has been integrated after the start of heating, and FIG. 11E illustrates an amount of electric power which has been integrated within a predetermined time during the first heating control mode.

DETAILED DESCRIPTION OF THE INVENTION

Hereinafter, embodiments of the present invention will be described with reference to the drawings.

First Embodiment

1.1 Configuration of Induction Heating Cooker

Figure 1:
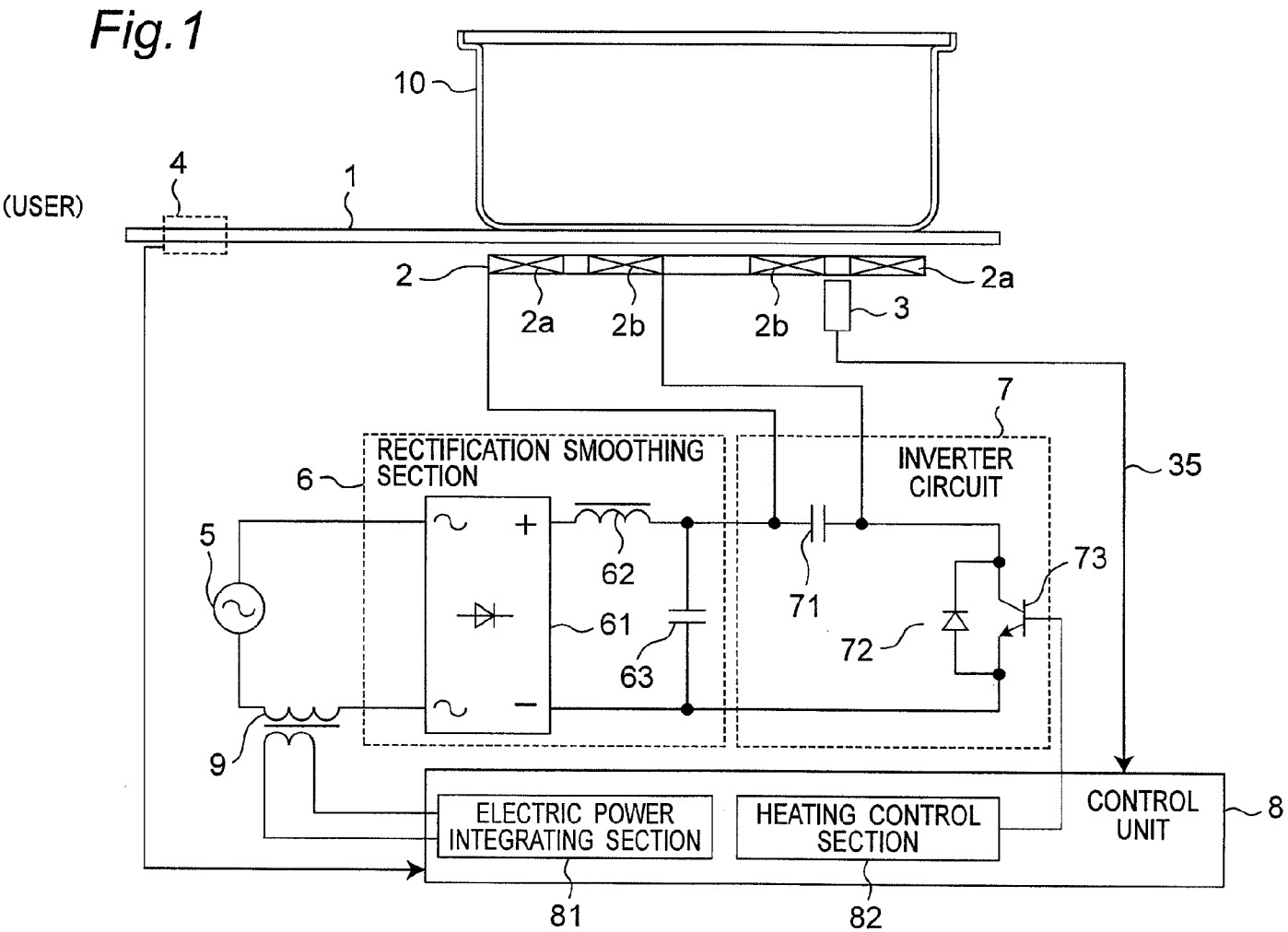
FIG. 1 is a block diagram illustrating a configuration of induction heating cookers according to a first embodiment and a second embodiment of the present invention.

FIG. 1 illustrates a configuration of an induction heating cooker according to a first embodiment of the present invention. The induction heating cooker according to the present embodiment includes an infrared ray sensor 3, and controls an amount of heating electric power thereafter based on an integrated value of input electric power required until a temperature detected by the infrared ray sensor 3 reaches a predetermined value to heat a cooking container 10 such as a pan.

The induction heating cooker according to the first embodiment of the present invention includes a top plate 1 provided at the upper surface of the device, and a heating coil 2 which performs induction heating of the cooking container 10 on the top plate 1 by generating a high-frequency magnetic field. The top plate 1 is made of an electrically-insulating material, such as glass, and transmits infrared rays. The heating coil 2 is provided under the top plate 1. The heating coil 2 is concentrically partitioned into two parts to form an outer coil 2*a* and an inner coil 2*b*. A gap is provided between the outer coil 2*a* and the inner coil 2*b*. The cooking container 10 generates heat due to eddy currents induced by the high-frequency magnetic field from the heating coil 2.

At a portion of the top plate 1 which is closer to a user, an operation section 4 including a plurality of switches is provided. For example, the operation section 4 includes a heating start/stop switch which enables the user to generate commands for starting/stopping of heating.

The infrared ray sensor 3 is provided halfway in a radial direction of the cooking container 10 and, in the present embodiment, under the gap between the outer coil 2*a* and the inner coil 2*b*. This position is strongly subjected to a high-frequency magnetic field from the heating coil 2, and therefore, it is possible to detect a substantially-highest temperature in the bottom surface of the cooking container 10 at this position. The infrared ray which is radiated from the bottom surface of the cooking container 10 based on the temperature of the bottom surface of the cooking container 10 enters the top plate 1, passes through the gap between the outer coil 2*a* and the inner coil 2*b* and then is received by the infrared ray sensor 3. The infrared ray sensor 3 detects the received infrared ray and outputs an infrared-ray detection signal 35 based on the detected amount of infrared ray.

Under the heating coil 2, there are provided a rectification smoothing section 6 which converts an alternating voltage supplied from a commercial power supply 5 into a direct voltage, and an inverter circuit 7 which creates a high-frequency current from the direct voltage supplied from the rectification smoothing section 6 and outputs the created high-frequency current to the heating coil 2. The rectification smoothing section 6 includes a full-wave rectifier 61 constituted by a bridge diode, and a low-pass filter which is constituted by a choke coil 62 and a smoothing capacitor 63 and is connected between the output terminals of the full-wave rectifier 61. The inverter circuit 7 includes a switching element 73 (an IGBT in the present embodiment), a diode 72 connected in inverse-parallel to the switching element 73, and a resonance capacitor 71 connected in parallel to the heating coil 2. When the switching element 73 in the inverter circuit 7 is turned on and off, a high-frequency current is generated. The inverter circuit 7 and the heating coil 2 constitute a high-frequency inverter.

An input-current detection section 9 for detecting an input current flowing from the commercial power supply 5 to the rectification smoothing section 6 is provided between the commercial power supply 5 and the rectification smoothing section 6. The input-current detection section 9 is a current transformer in the present embodiment.

The induction heating cooker according to the present embodiment includes a control unit 8 including an electric power integrating section 81 which integrates the input electric power, and a heating control section 82 which controls the inverter 7. The electric power integrating section 81 integrates the input electric power based on the input electric current detected by the input-current detection section 9 to calculate an integrated amount of electric power outputted from the inverter circuit 7. The heating control section 82 outputs driving signals for controlling ON/OFF switching of the switching element 73 in the inverter circuit 7 to control the high-frequency current supplied to the heating coil 2 from the inverter circuit 7. The heating control section 82 controls ON/OFF switching of the switching element 73 based on signals transmitted thereto from the operation section 4, the temperature detected by the infrared ray sensor 3, and the integrated amount of electric power calculated by the electric power integrating section 81.

Figure 2:
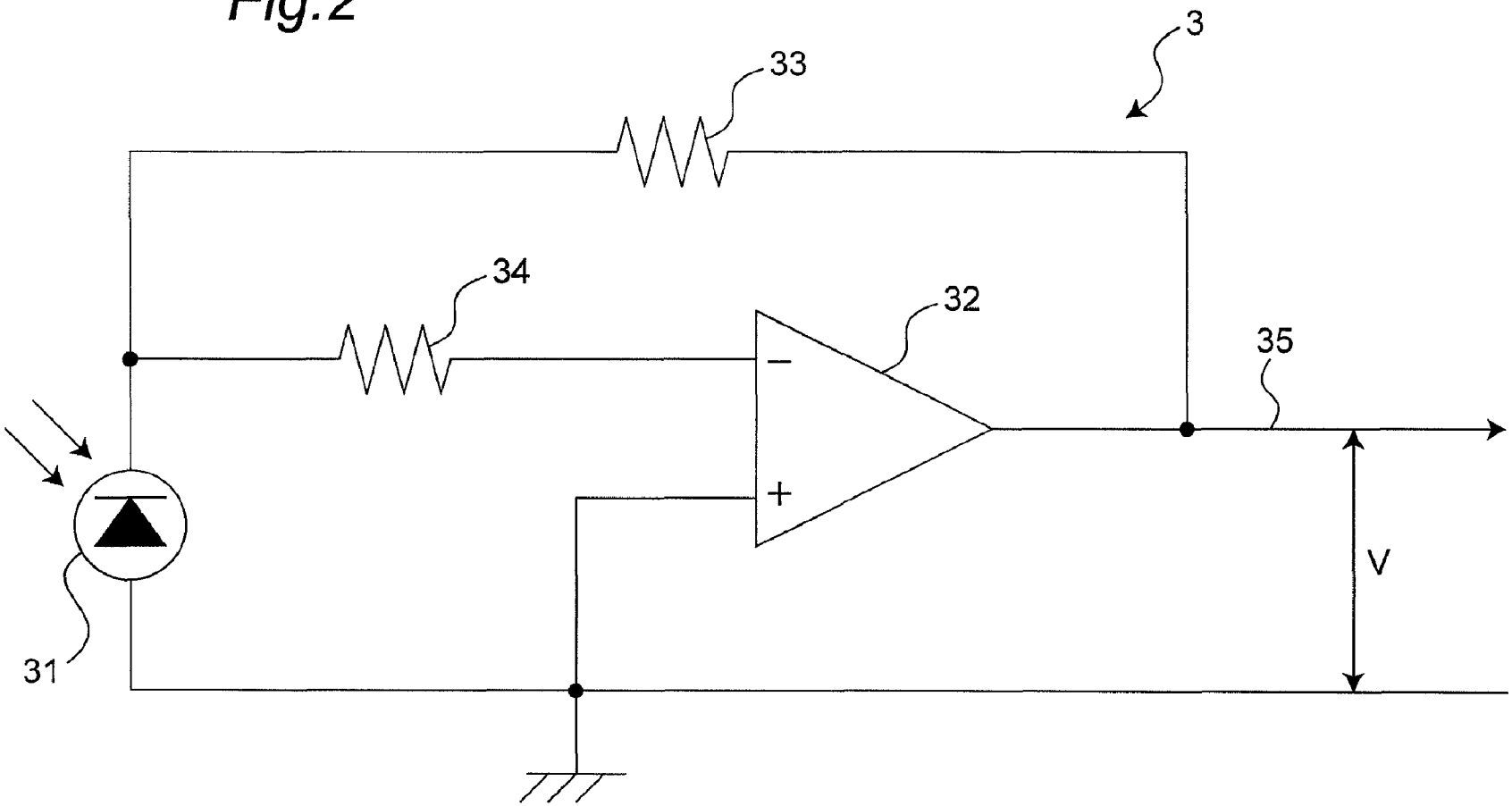
FIG. 2 is a circuit diagram of an infrared ray sensor used in the induction heating cookers according to the first embodiment and the second embodiment of the present invention.

FIG. 2 illustrates a circuit diagram of the infrared ray sensor 3. The infrared ray sensor 3 includes a photo diode 31, an operational amplifier 32 as an amplifier, and resistors 33 and 34. The resistors 33 and 34 are connected at their one ends to the photo diode 31, and also are connected at the other ends to the output terminal and the inverting input terminal of the operational amplifier 32, respectively. The photo diode 31 is a light receiving element made of silicon and the like which flows an electric current therethrough when being irradiated with an infrared ray having a wavelength equal to or less than about 3 micrometers which passes through the top plate 1, and is provided at a position where infrared rays radiated from the cooking container 10 can be received. The operational amplifier 32 constitutes a current conversion circuit and an amplification circuit. The current generated from the photo diode 31 is amplified by the operational amplifier 32, and the amplified current is outputted to the control unit 8 as an infrared-ray detection signal 35 (corresponding to a voltage value V) indicative of the temperature of the cooking container 10. The infrared ray sensor 3 receives the infrared rays radiated from the cooking container 10 and therefore has excellent thermal responsivity in comparison with a thermistor which detects the temperature through the top plate 1.

Figure 3:
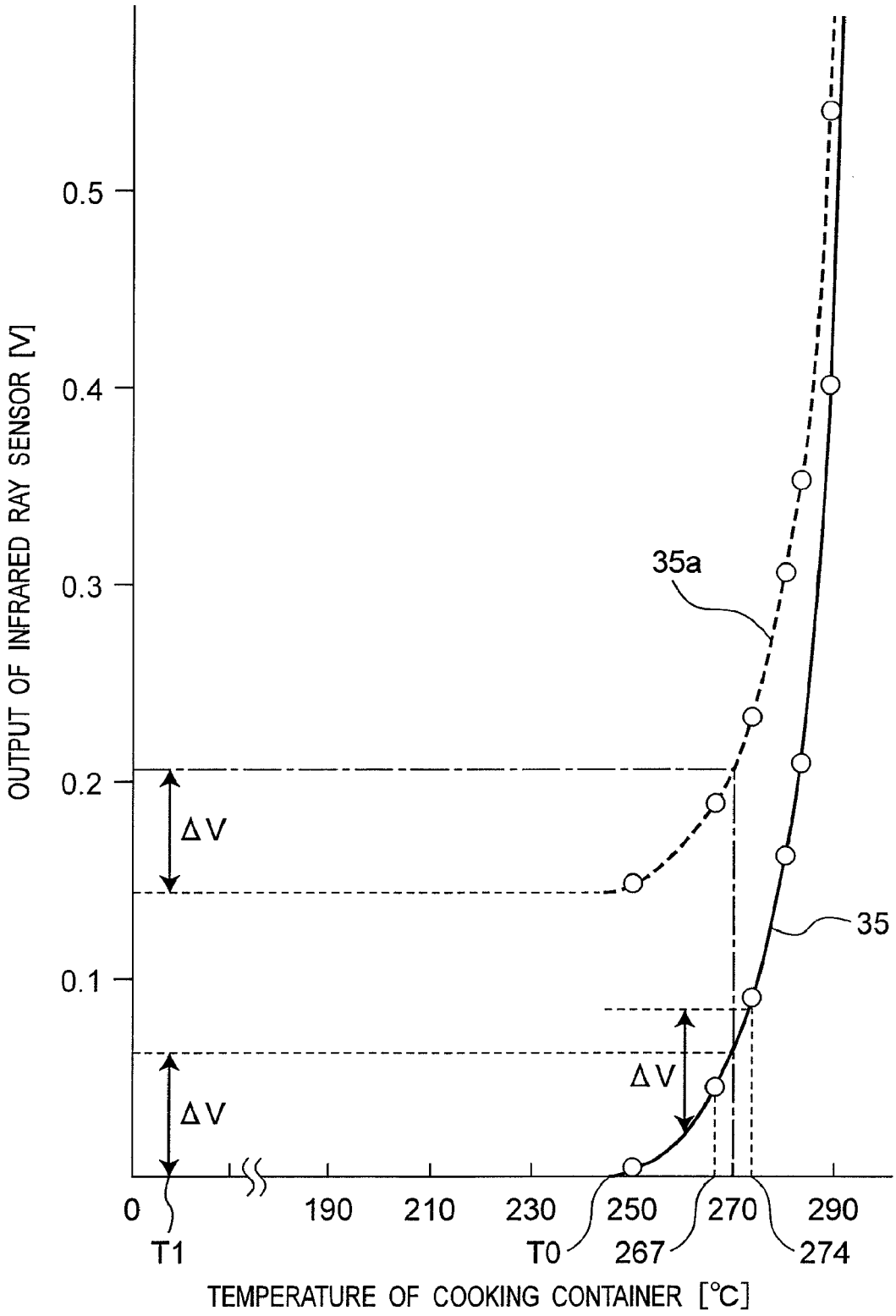
FIG. 3 is a characteristic view of the infrared ray sensor in FIG. 2.

FIG. 3 illustrates an output characteristic of the infrared ray sensor 3. In FIG. 3, a horizontal axis represents the temperature of the bottom surface of the cooking container 10, while a vertical axis represents the voltage value of the infrared-ray detection signal 35 outputted from the infrared ray sensor 3. In the present embodiment, it is necessary only to prevent the cooking container 10 from being excessively heated, and therefore, the infrared ray sensor 3 has a characteristic of outputting the infrared-ray detection signal 35 when the temperature of the bottom surface of the cooking container 10 is equal to or more than about 250° C., and outputting no infrared-ray detection signal 35 when the temperature of the bottom surface of the cooking container 10 is lower than about 250° C. In this case, the description "outputting no infrared-ray detection signal 35" includes outputting substantially no infrared-ray detection signal, that is, outputting a signal faint enough to prevent the control unit 8 from substantially reading out the temperature change in the bottom surface of the cooking container 10 based on the change of the magnitude of the infrared-ray detection signal 35, as well as outputting no infrared-ray detection signal 35 at all. The amplification factor of the amplifier 32 is set such that the output value of the infrared-ray detection signal 35 exhibits a characteristic of nonlinearly and monotonically increasing in such a way as to increase the inclination of its increase with a rising temperature of an object to be heated and increases exponentially if the range in which signals are outputted, that is, the temperature of the cooking container 10 reaches a temperature equal to or more than a predetermined temperature (about 250° C.). Further, the infrared ray sensor 3 has such an output characteristic that the output rising temperature T0 shifts to a higher temperature if the amplification factor of the amplifier 32 is decreased or if an infrared-ray detection element with lower light receiving sensitivity is employed. Further, the output characteristic of the infrared ray sensor 3 shifts to a higher-output range as represented by an infrared-ray detection signal 35*a* when static disturbing light such as sunlight enters the infrared ray sensor 3.

1.2 Operations of Induction Heating Cooker

The induction heating cooker according to the present embodiment heats a cooking container according to a control method including an initial control mode, a first heating control mode, and a second heating control mode. In this case, the "initial control mode" is a control mode which is executed at first if the user generates a command to start heating. The "first heating control mode" and the "second heating control mode" are control modes which are executed after the execution of the initial control mode for a predetermined time. The "first heating control mode" is a control mode suitable for a state where the bottom surface of the cooking container has a small thickness or the cooking container is heated in an empty state. The "second heating control mode" is a control mode suitable for a state where the bottom surface of the cooking container has a large thickness or the cooking container contains ingredients. Hereinafter, the heating control of a cooking container by using these control modes will be described in detail with reference to FIGS. 4 to 8D.

Figure 4:
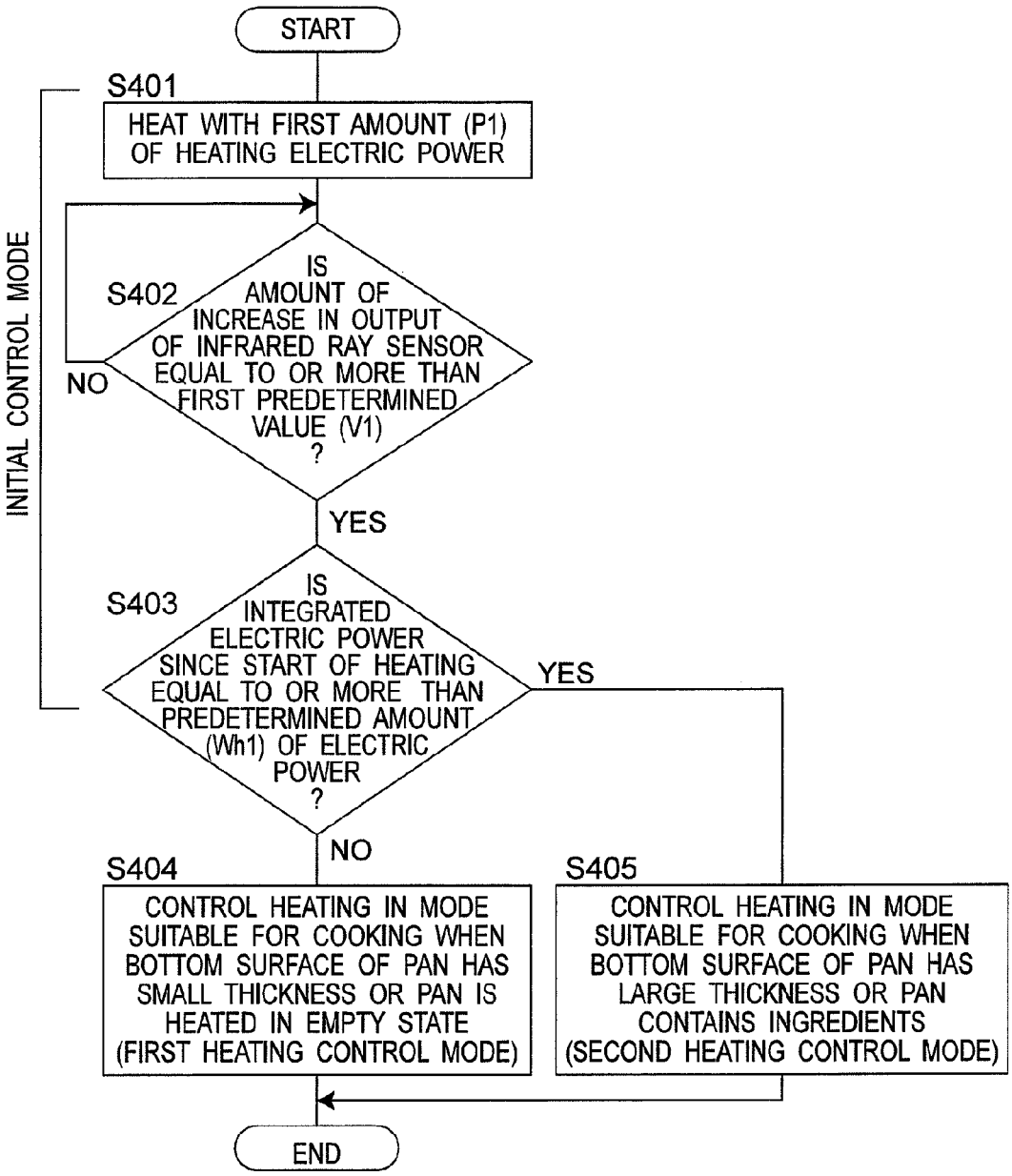
FIG. 4 is a flow chart illustrating operations of a transition from an initial control mode to a first heating control mode or a second control mode according to the first embodiment and the second embodiment of the present invention.
Figure 5:
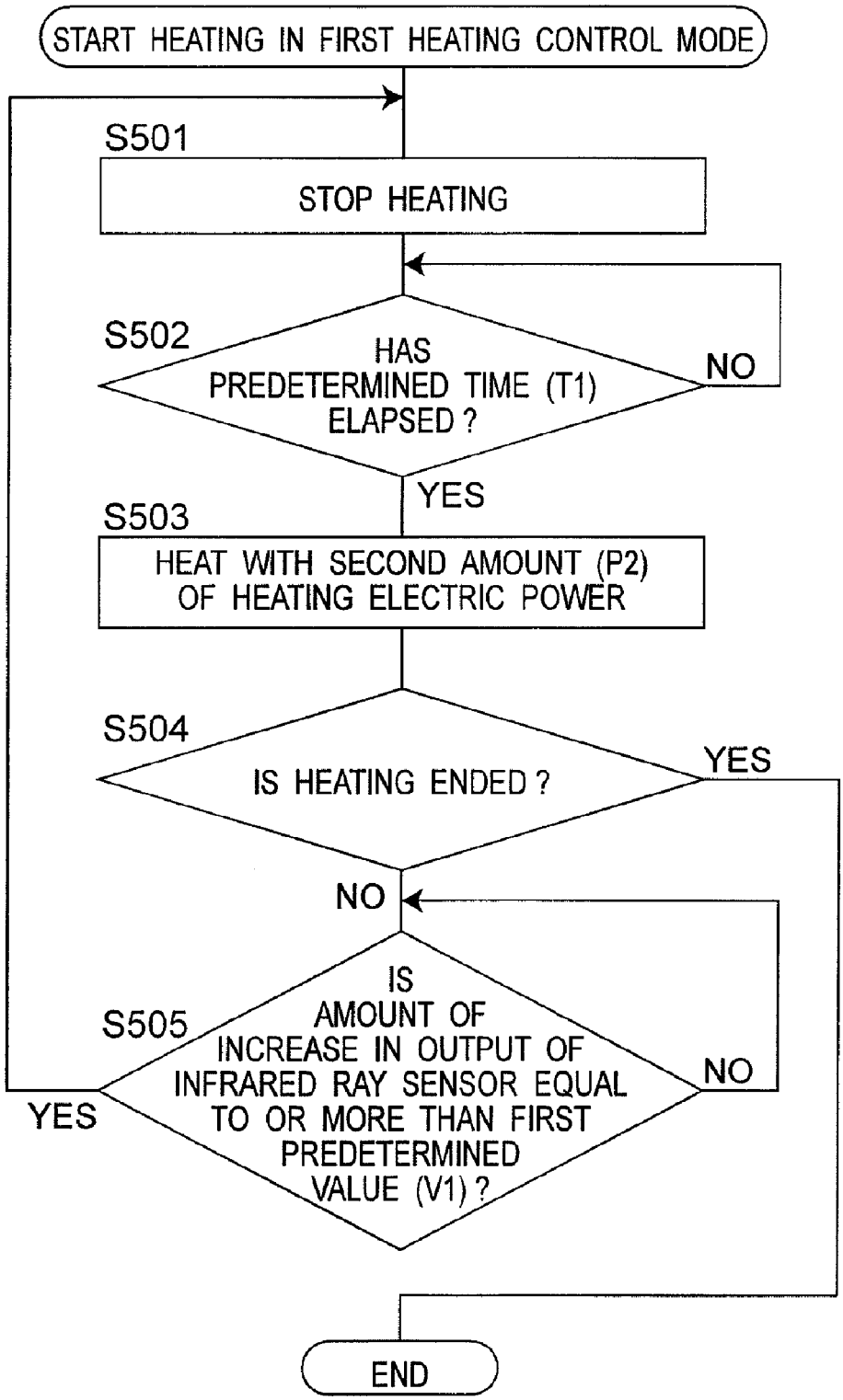
FIG. 5 is a flow chart illustrating operations in the first heating control mode according to the first embodiment of the present invention.
Figures 6A, 6B, 6C, 6D:
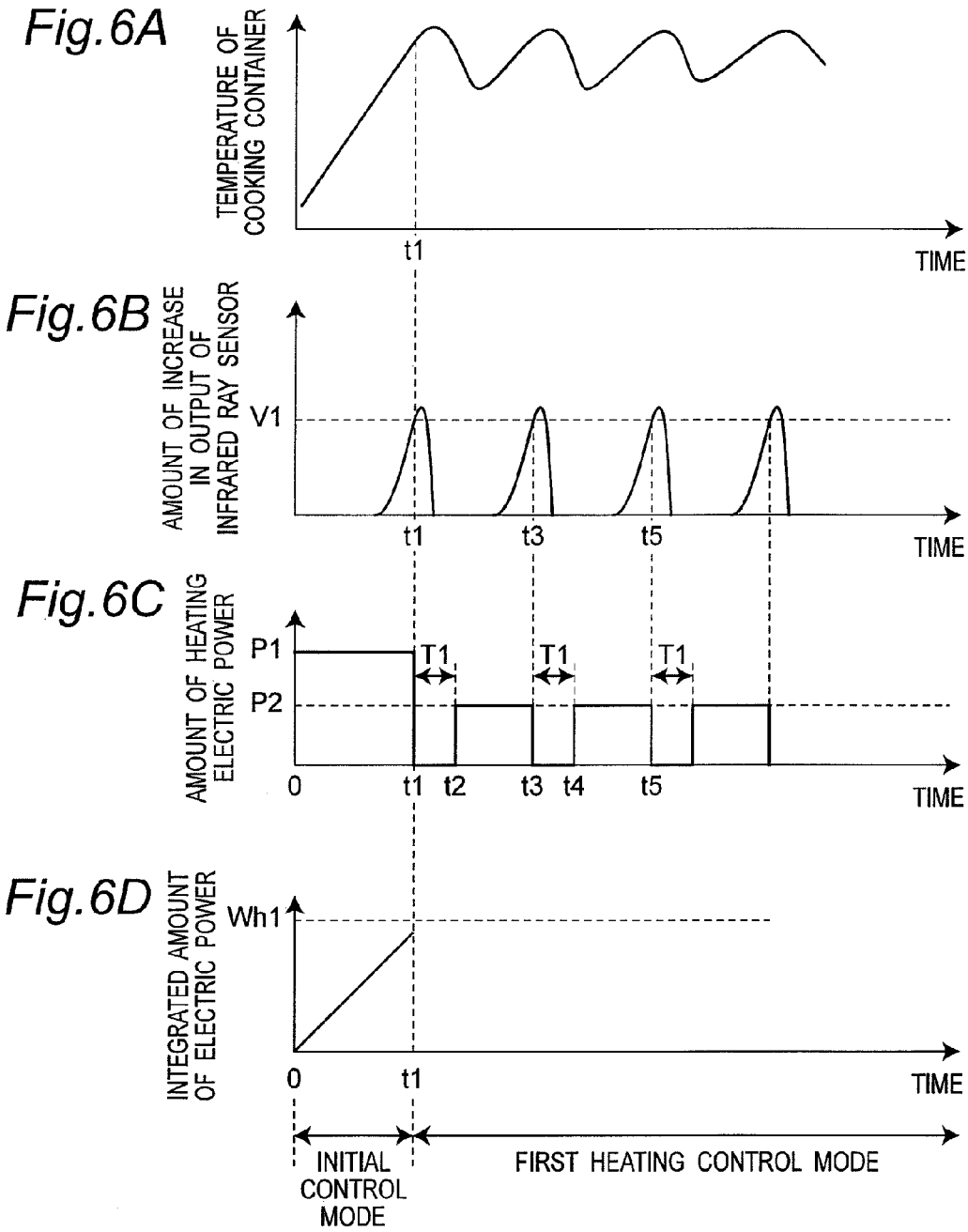
Figure 7:
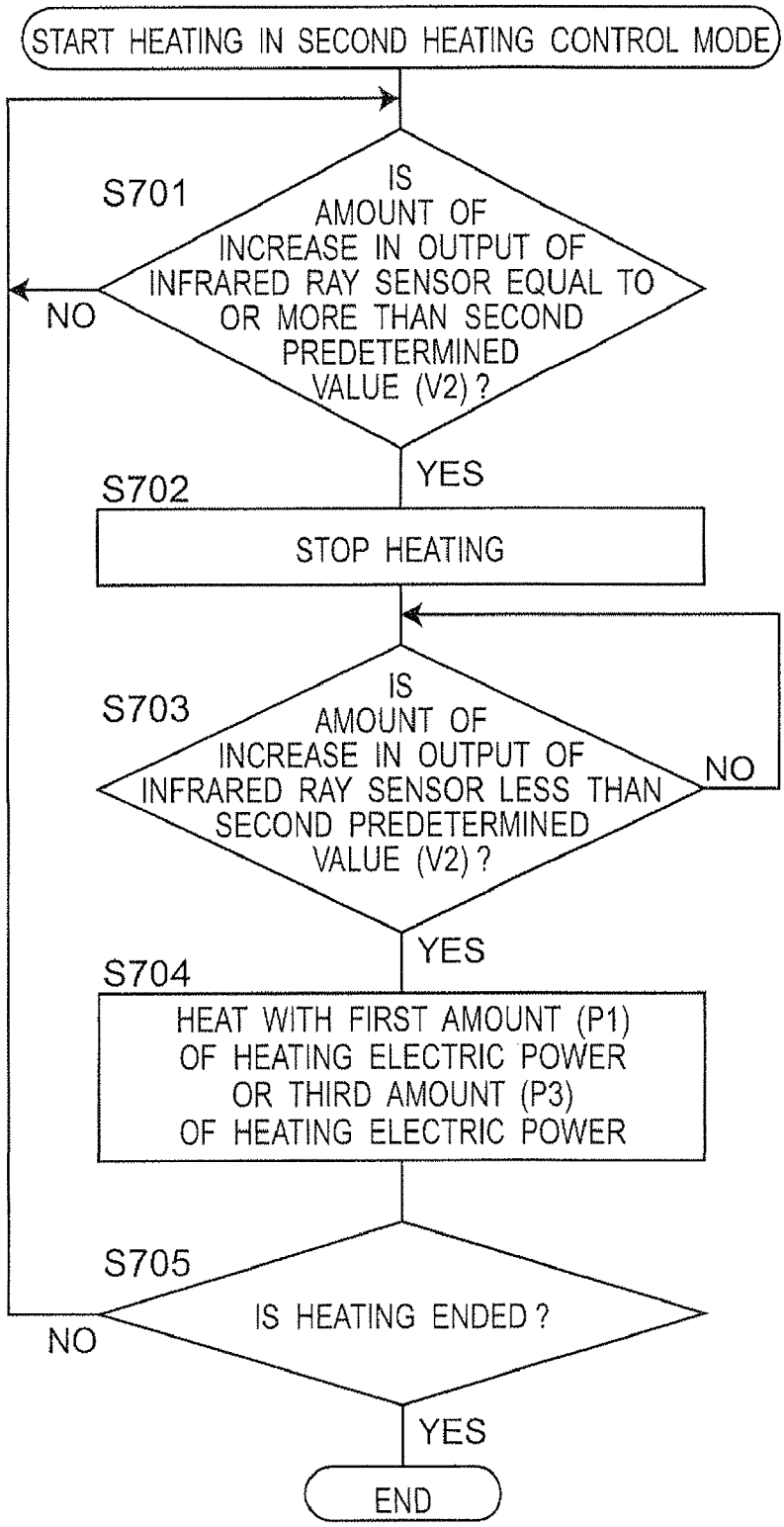
FIG. 7 is a flow chart illustrating operations in the second heating control mode according to the first embodiment of the present invention.
Figures 8A, 8B, 8C, 8D:
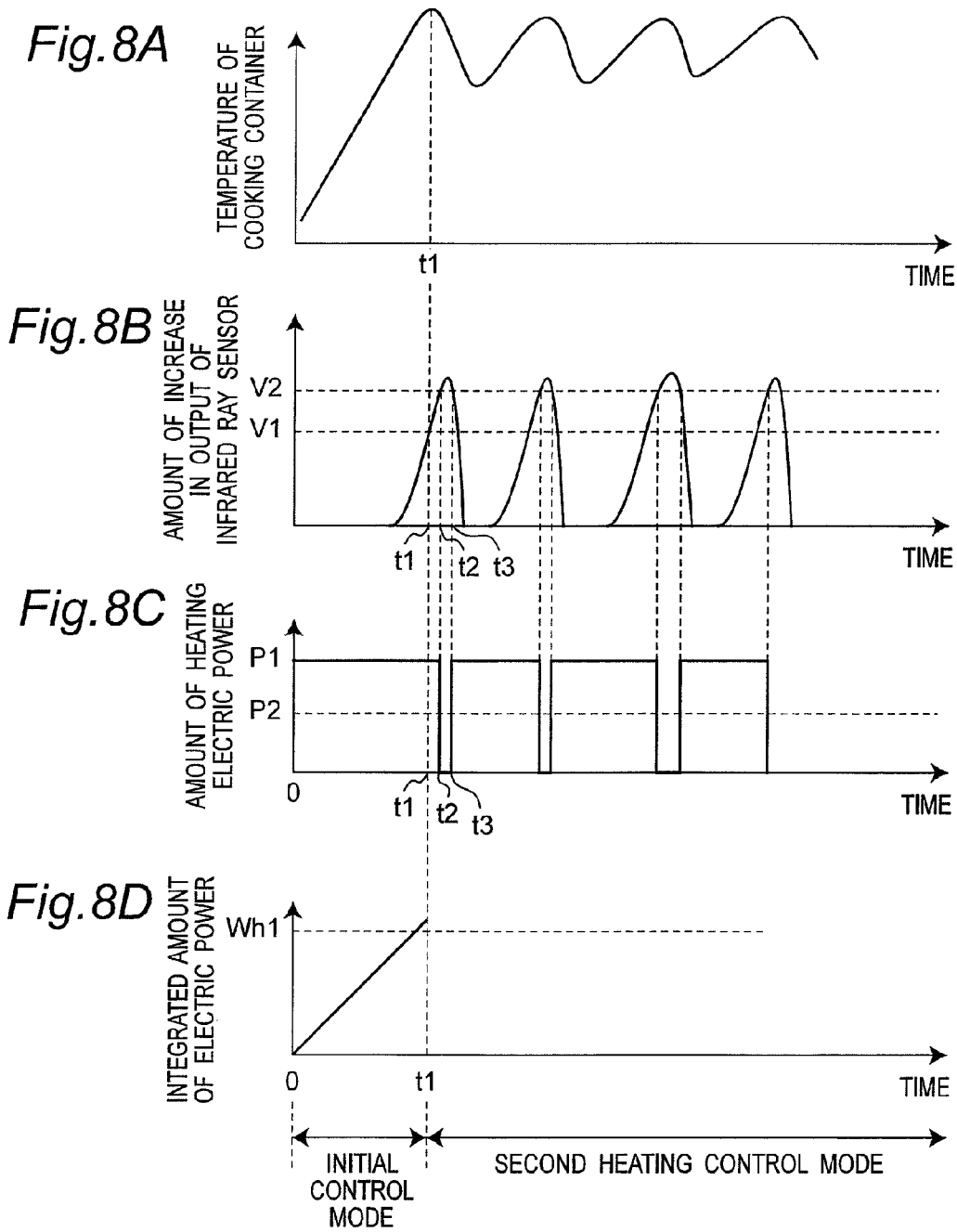

FIG. 4 is a flow chart illustrating the transition from the initial control mode to the first heating control mode or the second control mode. FIG. 5 is a flow chart illustrating heating control in the first heating control mode. FIGS. 6A-6D illustrate waveforms in the initial control mode and in the first heating control mode, wherein FIG. 6A illustrates the temperature of the bottom surface of the cooking container 10 during heating, FIG. 6B illustrates the amount of increase in the output of the infrared ray sensor 3, FIG. 6C illustrates the amount of heating electric power, and FIG. 6D illustrates the integrated amount of electric power. FIG. 7 is a flow chart illustrating heating control in the second heating control mode. FIGS. 8A-8D illustrate waveforms in the initial control mode and in the second heating control mode, wherein FIG. 8A illustrates the temperature of the bottom surface of the cooking container 10 during heating, FIG. 8B illustrates the amount of increase in the output of the infrared ray sensor 3, FIG. 8C illustrates the amount of heating electric power, and FIG. 8D illustrates the integrated amount of electric power.

FIG. 4 will be described first. If the cooking container 10 is placed on the top plate 1 illustrated in FIG. 1, and the heating start/stop switch in the operation section 4 is operated to generate a command to start heating, the heating control section 82 drives the inverter circuit 7 to cause the heating coil 2 to generate a high-frequency magnetic field, thereby starting heating of the cooking container 10. At this time, the heating is started such that the amount of heating electric power becomes a first amount P1 of heating electric power (for example, 3 kW) for high heating power (S401) (see FIG. 6C and FIG. 8C). Further, it is not necessary to maintain the first amount P1 of heating electric power at a constant value, and the first amount P1 of heating electric power can be set to be an amount of heating electric power necessary for raising the temperature of the cooking container 10.

After the start of heating, the cooking container 10 generates heat due to eddy currents generated by the high-frequency magnetic field from the heating coil 2. The infrared ray sensor 3 detects the temperature of the cooking container 10 based on infrared rays radiated from the cooking container 10. The infrared ray sensor 3 provided halfway in a radial direction of the cooking container 10 exists at a position which strongly experiences the high-frequency magnetic field, and therefore detects a substantially highest temperature in the bottom surface of the cooking container 10. The output from the infrared ray sensor 3 increases with rising temperature of the cooking container 10. The heating control section 82 determines whether or not the amount of increase in the output of the infrared ray sensor 3 from the output value of the infrared ray sensor 3 at the start of heating with the first amount of heating electric power has reached a value equal to or more than a first predetermined value V1 (S402) (see FIG. 6B and FIG. 8B).

If the amount of increase in the output of the infrared ray sensor 3 has become equal to or more than the first predetermined value V1 (Yes at S402, time t1 in FIG. 6B and FIG. 8B), the electric power integrating section 81 determines whether or not the amount of electric power which has been integrated after the start of heating is equal to or more than a predetermined amount Wh1 of electric power (a first predetermined amount of electric power) (S403) (see FIG. 6D and FIG. 8D). The predetermined amount Wh1 of electric power is set such that, when the bottom surface of the cooking container 10 has a small thickness or the cooking container 10 is heated in an empty state, the amount of electric power which has been integrated after the start of heating does not exceed the predetermined amount Wh1 of electric power, and when the bottom surface of the cooking container 10 has a large thickness or the cooking container 10 contains ingredients, the amount of electric power which has been integrated after the start of heating exceeds the predetermined amount Wh1 of electric power.

If the amount of electric power which has been integrated after the start of heating is not equal to or more than the predetermined amount Wh1 of electric power (No at S403), heating control is executed in the first heating control mode (S404) (see FIGS. 6A-6D). If the amount of electric power which has been integrated after the start of heating is equal to or more than the predetermined amount Wh1 of electric power (Yes at S403), heating control is executed in the second heating control mode (S405) (see FIGS. 8A-8D).

The first heating control mode will be described with reference to FIGS. 5 and 6A-6D. FIG. 5 is a flow chart illustrating the heating control at step S404 in FIG. 4 in detail. After the transition from the initial control mode to the first heating control mode, the heating control section 82 stops heating (S501) (see time t1 in FIG. 6C). The heating control section 82 determines whether or not a predetermined time T1 has elapsed after the stop of the heating (S502). If the predetermined time T1 has elapsed, the heating control section 82 starts heating with a second amount P2 of heating electric power (S503, see time t2 in FIG. 6C). In this case, the second amount P2 of electric power is a value (for example, 1.5 kW) which is smaller than the first amount P1 of heating electric power. Further, it is not necessary to maintain the second amount P2 of heating electric power at a constant value, and it is necessary only that the average of the second amount P2 of heating electric power is smaller than the average of the first amount P1 of heating electric power. Further, the predetermined time T1 is a time period required for lowering the amount of increase in the output of the infrared ray sensor 3 to below the first predetermined value V1.

The heating control section 82 determines whether or not the user has generated a command to end heating, through the operation section 4 (S504). If the command to end heating has been inputted, the heating control section 82 ends heating. If the command to end heating has not been inputted, the heating control section 82 determines whether or not the amount of increase in the output of the infrared ray sensor 3 has reached a value equal to or more than the first predetermined value V1 (S505). If the amount of increase in the output of the infrared ray sensor 3 has reached a value equal to or more than the first predetermined value V1 (Yes in S505), the heating control section 82 returns to step S501 to stop heating (see times t3 and t5 in FIG. 6B and FIG. 6C).

As described above, the first heating control mode includes repeating operations for heating the cooking container 10 with the second amount P2 of heating electric power for lower heating power, then stopping the heating if the amount of increase in the output of the infrared ray sensor 3 reaches a value equal to or more than the first predetermined value V1 and then heating the cooking container 10 again with the second amount P2 of electric power after the elapse of the predetermined time T1.

The second heating control mode will be described with reference to FIG. 7 and FIGS. 8A-8D. FIG. 7 is a flow chart illustrating the heating control at step S405 in FIG. 4 in detail. When the transition from the initial control mode to the second heating control mode occurs, the heating control section 82 has been heating the cooking container 10 with the first amount P1 of heating electric power larger than the second amount P2 of heating electric power. Further, in this case, it is also possible to employ a third amount P3 of heating electric power (for example, 2.5 kW) which is larger than the first amount P1 of heating electric power, instead of the first amount P1 of heating electric power. Further, it is not necessary to maintain the third amount P3 of heating electric power at a constant value, and it is necessary only that the average of the third amount P3 of heating electric power is larger than the average of the first amount P1 of heating electric power. The heating control section 82 determines whether or not the amount of increase in the output of the infrared ray sensor 3 has reached a value equal to or more than a second predetermined value V2 (S701) (see FIG. 8B). The second predetermined value V2 has a value larger than the first predetermined value V1. If the amount of increase in the output of the infrared ray sensor 3 has reached a value equal to or more than the second predetermined value V2 (Yes at S701), the heating control section 82 stops the heating (S702, see time t2 in FIG. 8B and FIG. 8C).

After stopping the heating, the heating control section 82 determines whether or not the amount of increase in the output of the infrared ray sensor 3 has reduced to below the second predetermined value V2 (S703). If the amount of increase in the output of the infrared ray sensor 3 has reduced to below the second predetermined value V2, the heating control section 82 again starts heating with the first amount P1 of heating electric power (S704, time t3 in FIG. 8B and FIG. 8C).

The heating control section 82 determines whether or not a command to end heating has been inputted through the operation section 4 (S705). If the command to end heating has been inputted through the operation section 4 (Yes at S705), the heating control section 82 ends the heating. If the command to end heating has not been inputted, the heating control section 82 returns to step S701.

As described above, the second heating control mode includes repeating operations for heating with the first amount P1 of heating electric power or the third amount P3 of heating electric power for higher heating power than that of the second amount P2 of heating electric power in the first heating control mode, then stopping the heating if the amount of increase in the output of the infrared ray sensor 3 reaches a value equal to or more than the second predetermined value V2 and then heating with the first amount P1 of heating electric power if the amount of increase in the output of the infrared ray sensor 3 becomes lower than the second predetermined value V2.

As described above, the amount of heating electric power in the second heating control mode is larger than that in the first heating control mode (P1, P3>P2), and the threshold value for determining the timing of stop of heating in the second heating control mode is larger than that in the first heating control mode (V2>V1). Accordingly, in the second heating control mode, the average heating electric power is larger than that in the first heating control mode, which increases the feeling of heating power for heating during cooking.

1.3 Conclusion

The induction heating cooker according to the present embodiment detects the temperature of the cooking container 10 by using the infrared ray sensor 3 which detects infrared rays radiated from the cooking container 10. Therefore, even when the bottom surface of the cooking container 10 is warped in a convex shape and therefore there is a gap between the cooking container 10 and the top plate 1, it is possible to detect the temperature of the bottom surface of the cooking container 10 with high accuracy, by following the temperature gradient in the cooking container 10, without being influenced by the gap.

Further, the temperature of the cooking container 10 is detected by the infrared ray sensor 3 having excellent thermal responsivity, which prevents the occurrence of a time delay between the temperature detected by the infrared ray sensor 3 and the actual temperature of the bottom surface of the cooking container 10. This enables detecting the actual temperature of the cooking container 10 with excellent accuracy. Accordingly, even when the bottom surface of the cooking container 10 has a small thickness, and the temperature of the cooking container 10 rapidly rises, it is possible to detect the temperature by following the rapid temperature rise.

The infrared ray sensor 3 sets the amplification factor of the operational amplifier 32 (the amplifier) such that the infrared-ray detection signal 35 has a nearly constant magnitude (zero, in this case) until the temperature of the bottom surface of the cooking container 10 reaches a predetermined temperature, and a increasing magnitude exponentially after the temperature of the bottom surface of the cooking container 10 exceeds the predetermined temperature. The heating control section 82 determines whether or not the amount ΔV of the increase in the output value of the infrared ray sensor 3 from the output value of the infrared ray sensor 3 at the start of heating with the first amount of heating electric power has reached the first predetermined value. Accordingly, it is possible to determine whether or not the temperature of the cooking container 10 has reached the predetermined temperature with excellent stability and accuracy, while suppressing the influence of disturbing light and the influence of the emissivity of the cooking container 10. Hereinafter, this will be described in detail with reference to FIG. 3.

In cases where the temperature T1 of the cooking container 10 at the start of heating is lower than a detection lower-limit temperature T0 (for example, 250° C.), the infrared-ray detection signal 35 outputted from the infrared ray sensor 3 substantially has a constant value. Therefore, at the time when a predetermined amount ΔV of increase from the initial output value V0 of the infrared-ray detection signal 35 is obtained during heating, the temperature T of the bottom surface of the cooking container 10 has a value which does not depend on the temperature T1 at the start of heating. In cases where the temperature T1 of the infrared ray sensor 3 at the start of heating is equal to or higher than the predetermined temperature T0 which is the detection lower-limit temperature, the infrared ray sensor 3 outputs an infrared-ray detection signal 35 which exhibits a characteristic of increasing in the manner of a so-called power function, in such a way that the gradient of the increase in the magnitude of the infrared-ray detection signal 35 increases with rising temperature T of the bottom surface of the cooking container 10. Accordingly, in cases where the temperature T1 of the infrared ray sensor 3 at the start of heating is equal to or higher than the predetermined temperature T0 which is the detection lower-limit temperature, the temperature T of the bottom surface of the cooking container 10 at the time when a predetermined amount ΔV of increase is obtained depends on the temperature T1 of the bottom surface at the start of heating, but, as the temperature T of the bottom surface of the cooking container 10 rises, the gradient of the infrared-ray detection signal 35 with respect to the change of the temperature T of the cooking container becomes more rapid, which reduces the change ΔT of the temperature of the cooking container 10 corresponding to the predetermined amount ΔV of increase. Accordingly, as the temperature T of the cooking container 10 rises, a predetermined amount ΔV of increase is obtained with a smaller temperature change ΔT, which enables detecting the temperature change and reducing the output or stopping the heating with excellent responsivity to suppress the temperature rise without being greatly influenced by the temperature T1 of the bottom surface at the start of heating. Further, even when disturbing light is continuously incident to the infrared ray sensor 3, the infrared-ray detection signal 35 represented by a solid line shifts in parallel toward a higher-output range and becomes an infrared-ray detection signal 35*a* represented by a broken line, which can substantially prevent the operations for detecting the temperature T of the bottom surface of the cooking container 10 from being influenced by the disturbing light.

Accordingly, with the aforementioned method, it is possible to determine with excellent responsivity and stability, using the infrared ray sensor 3, whether or not the integrated value from the electric power integrating section 81 is less than the first predetermined amount Wh1 of electric power, when the temperature of the cooking container 10 has reached the predetermined temperature. This enables stable detections for cooking containers 10 having large and small thermal capacities, such as those having bottom surfaces with large and small thicknesses.

Further, the infrared ray sensor 3 is provided halfway in a radial direction of the winding wire of the heating coil 2, that is, between the outer coil 2*a* and the inner coil 2*b*, to perform measurements on the bottom surface portion of the cooking container 10 positioned above between the winding wires of the outer coil 2*a* and the inner coil 2*b* at a position which strongly experiences the high-frequency magnetic field from the heating coil 2, which enables controlling the electric power supplied to the heating coil 2 with high detection sensitivity to a high-temperature portion of the cooking container 10. In this manner, excessive heating is reliably prevented.

Further, in the present embodiment, based on whether or not the integrated amount of electric power required until the temperature detected by the infrared ray sensor 3 reached the first predetermined value V1 has exceeded the predetermined amount Wh1 of electric power, the heating control thereafter is varied. That is, if it is determined that the bottom surface of the cooking container 10 has a small thickness or the cooking container 10 is being heated in an empty state, the cooking container 10 is heated by decreasing the heating power to the second amount P2 of heating electric power, and also the threshold value of the amount of increase in the output of the infrared ray sensor 3, which determines the timing of stopping the heating, is set to a smaller value V1. This enables the prevention of excessive heating when the cooking container 10 has a small thickness or the cooking container 10 is heated in an empty state. This further prevents the cooking container 10 from being deformed.

If it is determined that the bottom surface of the cooking container 10 has a large thickness or the cooking container 10 contains ingredients, the heating is continued while maintaining the first amount P1 of heating electric power for higher heating power, and also the threshold value of the amount of increase in the output of the infrared ray sensor 3, which determines the timing of stopping the heating, is set to a larger value V2. Accordingly, when a large amount of heating electric power is required and excessive heating will not occur even if a large amount of heating electric power is applied, such as at a state where the bottom surface of the cooking container 10 has a large thickness or the cooking container 10 contains ingredients, it is possible to heat the cooking container 10 with high heating electric power in a short period of time.

Further, the photo diode 31 made of silicon is employed as the light receiving element in the infrared ray sensor 3, which makes the infrared ray sensor 3 inexpensive.

1.4 Examples of Modifications

Further, in the initial control mode (step S402 in FIG. 4) and in the first heating control mode (step S505 in FIG. 5), it is also possible to set different values as the respective threshold values, instead of using the same first predetermined value V1. For example, the threshold value in the initial control mode (step S402 in FIG. 4) can be set lower than the threshold value in the first heating control mode (step S505 in FIG. 5). In this case, the second predetermined value V2 in the second heating control mode can be preferably set to be larger than the threshold value in the first heating control mode. When heating is performed with the first amount P1 of heating electric power for higher heating power, even a slight response delay tends to induce excessive heating. Accordingly, by lowering the threshold value for increasing the sensitivity, it is possible to prevent the occurrence of response delays. Further, when heating is performed with the second amount of heating electric power with reduced heating power, even in the event of the occurrence of a slight response delay, no excessive heating occurs, and therefore, it is possible to set the threshold value to be a larger value. As described above, it is possible to heat the cooking container 10 more suitably by setting different threshold values for heating with the first amount of heating electric power and for heating with the second amount of heating electric power.

Although in the present embodiment, in the second heating control mode illustrated in FIGS. 8A-8D, heating is performed with the same first amount P1 of heating electric power as that in the initial control mode, the third amount P3 of heating electric power in the second heating control mode is not limited to be the same as the first amount P1 of heating electric power. The third amount P3 of heating electric power in the second heating control mode is required only to be larger than the second amount P2 of heating electric power in the first heating control mode.

Further, although in the present embodiment, the heating is stopped at step S501 in FIG. 5 and at step 702 in FIG. 7, it is also possible to limit the heating, instead of stopping the heating. For example, at step S501 in FIG. 5, it is also possible to perform heating with an amount of heating electric power which is smaller than the second amount P2 of heating electric power. Further, at step S702 in FIG. 7, it is also possible to perform heating with an amount of heating electric power which is lower than the first amount P1 of heating electric power.

Further, it is also possible to add a step of determining whether or not the amount of increase in the output of the infrared ray sensor 3 is less than the first predetermined value V1, instead of step S502 in FIG. 5, and it is possible to start heating with the second amount P2 of heating electric power if the amount of increase in the output of the infrared ray sensor 3 is less than the first predetermined value V1. The same can be applied to a second embodiment which will be described later.

Note that the integrated amount of electric power may be an amount which has been determined in a simple way. For example, it is possible to replace the amount with the heating time when control is performed in such a way as to maintain the input current constant.

Second Embodiment

2.1 Operations of Induction Heating Cooker

The present embodiment is different from the first embodiment in the control after the integrated electric power has reached the predetermined amount Wh1 of electric power (the control from step S403 in FIG. 4). In the first embodiment, while the first heating control mode (S404) or the second heating control mode (S405) is executed, the heating is continued in the control mode determined at first, without performing changeover to the other heating control mode during the heating. However, in the present embodiment, it is possible to perform changeover between a first heating control mode and a second heating control mode during heating. The induction heating cooker according to the present embodiment has the same configuration as that of the first embodiment.

Figure 9:
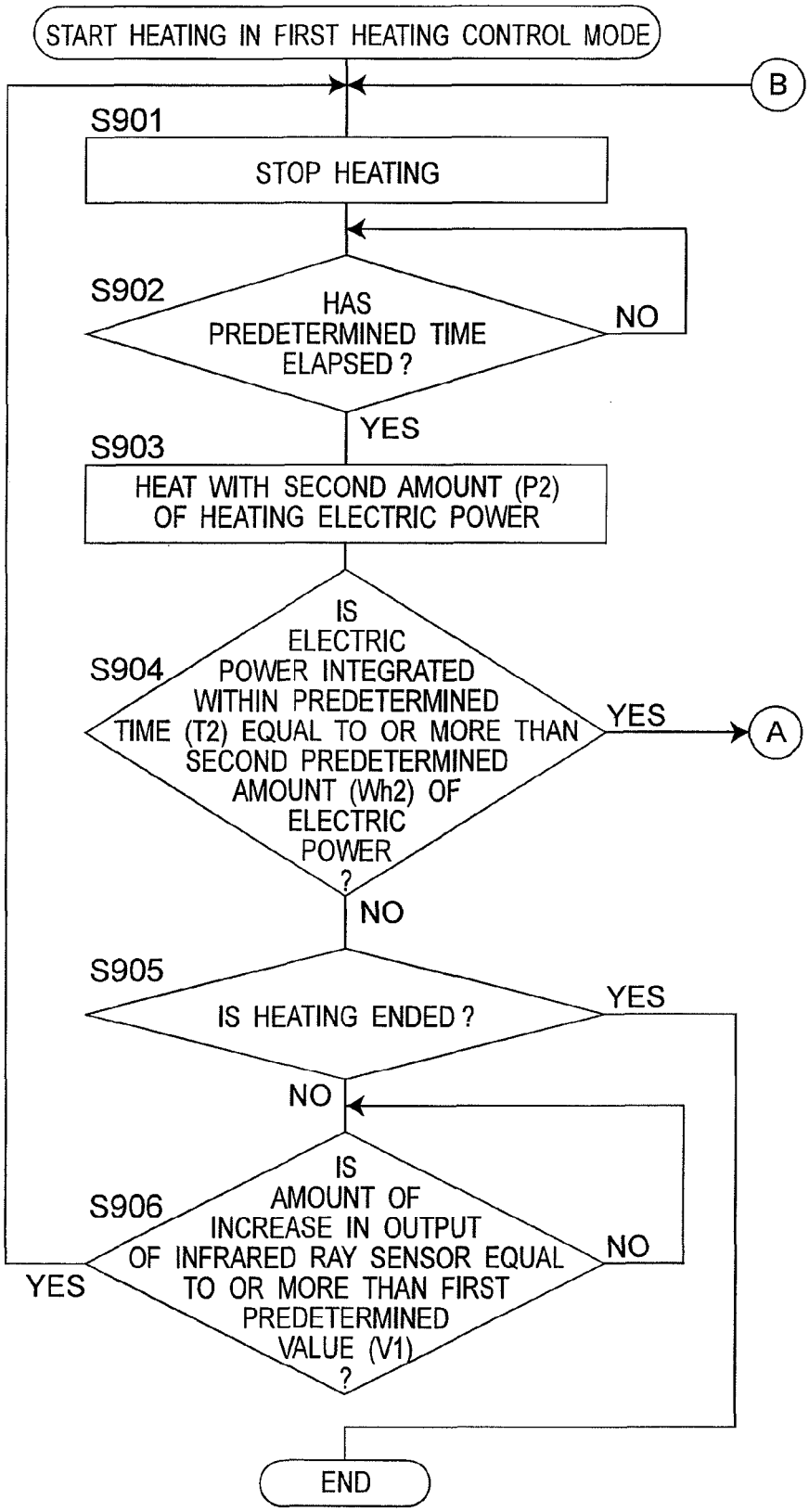
FIG. 9 is a flow chart illustrating operations in a first heating control mode according to a second embodiment of the present invention.
Figure 10:
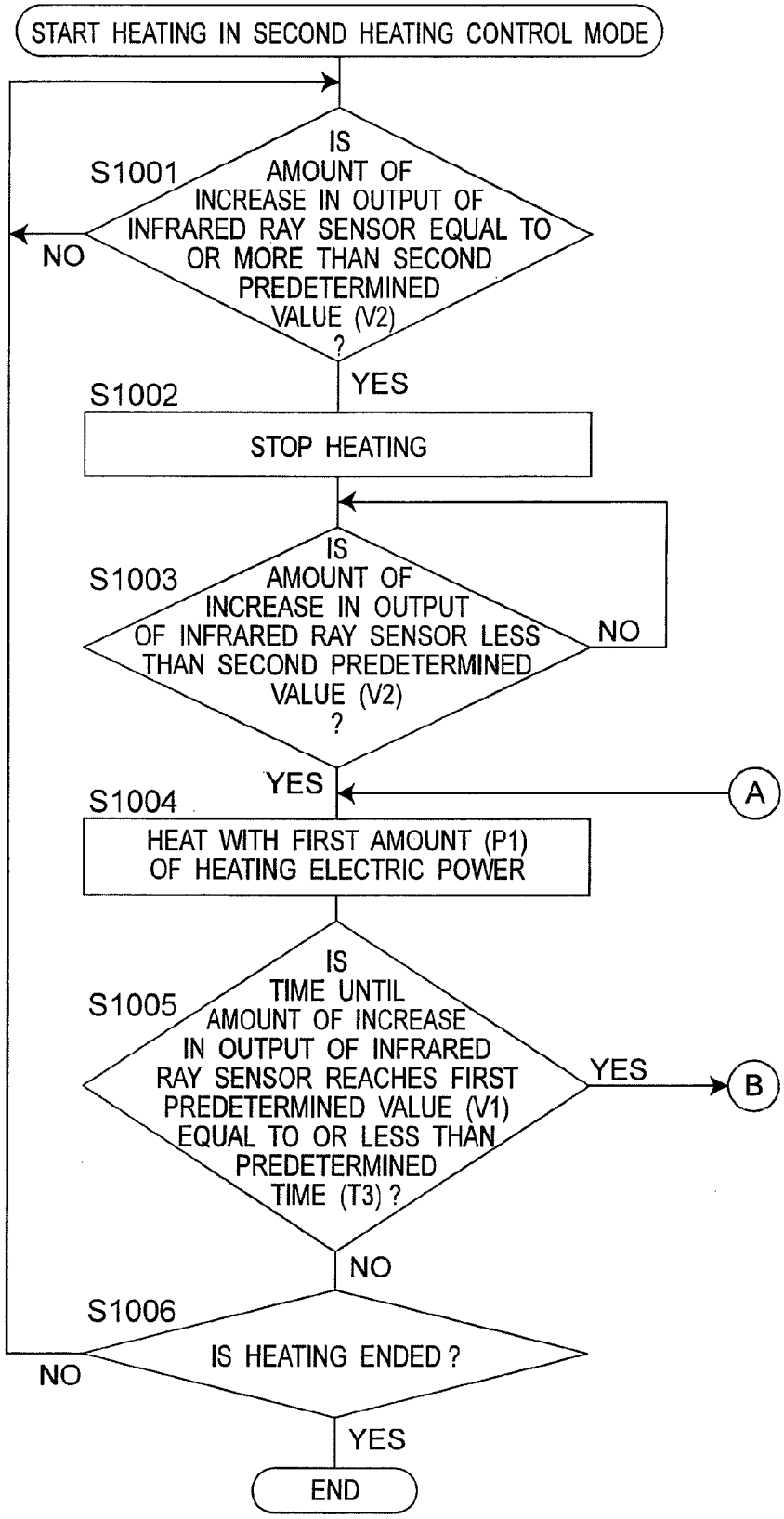
FIG. 10 is a flow chart illustrating operations in a second heating control mode according to the second embodiment of the present invention.

The operations different from those in the first embodiment will be described with reference to FIGS. 9 to 11E. FIG. 9 is a flow chart illustrating the first heating control mode in the present embodiment. FIG. 10 is a flow chart illustrating a second heating control mode in the present embodiment. FIGS. 11A-11E illustrate waveforms in the case where the transition from an initial control mode to the first heating control mode occurs and, thereafter, the changeover between the first heating control mode and the second heating control mode occurs, wherein FIG. 11A illustrates the temperature of the bottom surface of the cooking container 10 during heating, FIG. 11B illustrates the amount of increase in the output of the infrared ray sensor 3, FIG. 11C illustrates the amount of heating electric power, FIG. 11D illustrates the amount of electric power which has been integrated after the start of heating, and FIG. 11E illustrates the amount of electric power which has been integrated within a predetermined time T2.

With reference to FIGS. 9 and 11A-11E, operations of the induction heating cooker in the first heating control mode will be described. In the present embodiment, it is possible to perform changeover from the first heating control mode to the second heating control mode, and therefore, there is additionally provided a new step S904 for determining whether or not to change the control mode. Steps S901 to S906, except step S904, are the same as steps S501 to S505 in FIG. 5 in the first embodiment. The different step S904 will be described.

The electric power integrating section 81 determines whether or not the amount of electric power integrated within a predetermined time T2 has reached a value equal to or more than a predetermined amount Wh2 of electric power (a second predetermined amount of electric power) during heating with the second amount of heating electric power in the first heating control mode (S904) (see FIG. 11E). If the amount of electric power integrated within the predetermined time T2 is equal to or more than the predetermined amount Wh2 of electric power (Yes at S904), the transition to the second heating control mode occurs, and heating with a first amount P1 of heating electric power for higher heating power is started (S1004 in FIG. 10) (see time t5 in FIG. 9C). Hereinafter, heating control in the second heating control mode is executed. Thus, for example, when ingredients are introduced into the cooking container 10 at a state where the empty cooking container 10 is heated with low heating power, it is possible to change the heating to heating with higher heating power to heat the cooking container 10. This enables completion of cooking in a short time. If the amount of electric power integrated within the predetermined time T2 is not equal to or more than the predetermined amount Wh2 of electric power (No at S904), the heating in the first heating control mode is continued.

With reference to FIGS. 10 and 11A-11E, operations of the induction heating cooker in the second heating control mode will be described. In the present embodiment, it is possible to perform changeover from the second heating control mode to the first heating control mode, and therefore, there is additionally provided a new step S1005 for determining whether or not to change the control mode. Steps S1001 to S1006, except step S1005, are the same as steps S701 to S705 in FIG. 7 in the first embodiment. The different step S1005 will be described.

After starting heating with the first amount P1 of heating electric power after stopping the heating in the second heating control mode, the heating control section 82 determines whether or not the time required for the amount of increase in the output of the infrared ray sensor 3 to reach the first predetermined value V1 is equal to or less than a predetermined time T3 (S1005) (see times T6 to t7 in FIG. 11C). If the time required for the amount of increase in the output of the infrared ray sensor 3 to reach the first predetermined value V1 is equal to or less than the predetermined time T3, the heating control section 82 shifts to the first heating control mode to stop heating at first (S901) (see time t7 in FIG. 11C). Hereinafter, heating control in the first heating control mode is executed. Thus, for example, when ingredients are removed from the cooking container 10 at a state where the cooking container 10 containing the ingredients is heated with high heating power, it is possible to change the heating to heating with lower heating power to heat the cooking container 10. In this manner, the cooking container 10 can be prevented from being excessively heated. If the time required for the amount of increase in the output of the infrared ray sensor 3 to reach the first predetermined value V1 is not equal to or less than the predetermined time T3 (No at S1005), the heating in the second heating control mode is continued.

2.2 Conclusion

The present embodiment enables changeover from the first heating control mode to the second heating control mode. More specifically, if the electric power integrated within the predetermined time T2 exceeds the predetermined amount Wh2 of electric power at an arbitrary time during heating with the second amount P2 of heating electric power for low heating power, the amount of heating electric power is changed to the first amount P1 of heating electric power for higher heating power. Accordingly, when the state of the cooking container is changed from a state where it is heated in an empty state to a state where it contains ingredients, it is possible to heat the cooking container in the heating control mode suitable for the changed state. Such changing of the heating control mode is suitable for cases of starting heating of the cooking container 10 with only a small amount of oil contained therein, then preheating the cooking container 10 until the temperature thereof exceeds about 200° C. and, thereafter, introducing meat, onion and the like therein and sautéing them, such as in the case of meat and potatoes. In the preheating processing for heating the cooking container with only oil contained therein, the first heating control mode is selected for preventing the cooking container 10 from being excessively heated, and in the processing for introducing and sautéing ingredients, the heating control mode is changed to the second heating control mode, which enables sautéing the ingredients with higher heating power.

Further, the present embodiment also enables changeover from the second heating control mode to the first heating control mode. More specifically, if the time required for causing the first predetermined value V1 to be reached is equal to or less than the predetermined time T3 during heating with the first amount P1 of heating electric power for higher heating power, the amount of heating electric power is changed to the second amount P2 of heating electric power for lower heating power. Accordingly, when ingredients are removed from the cooking container 10 during heating to change the state of the cooking container 10 to a state where it is heated in an empty state, it is possible to prevent the cooking container 10 from being excessively heated.

2.3 Examples of Modifications

Further, the timing of determination whether or not to change from the first heating control mode to the second heating control mode (S904) and the timing of determination whether or not to change from the second heating control mode to the first heating control (S1005) are not limited to the timings illustrated in FIGS. 9 and 10, respectively. It is possible to determine whether or not to change from the first heating control mode to the second heating control mode (S904) at arbitrary timing during the first heating control mode. Further, it is possible to determine whether or not to change from the second heating control mode to the first heating control mode (S1005) at arbitrary timing during the second heating control mode.

The induction heating cooker according to the present embodiment has an effect of preventing pans having pan bottoms warped in convex shapes and pans having pan bottoms with smaller thicknesses from being excessively heated and, therefore, the induction heating cooker is usable as a cooking device for use in ordinary households.

The invention claimed is:

1. An induction heating cooker comprising:

a top plate made of a material capable of transmitting an infrared ray;

a heating coil operable to perform induction heating of a cooking container placed on the top plate with a supplied high-frequency current;

an inverter circuit operable to supply the high-frequency current to the heating coil;

an infrared ray sensor including an amplifier and being operable to detect the infrared ray which is radiated from a bottom surface of the cooking container and passes through the top plate and to output a detection signal corresponding to a temperature of the bottom surface of the cooking container;

an electric power integrating section operable to integrate an amount of heating electric power outputted from the inverter circuit; and a heating control section operable to control the high-frequency current outputted from the inverter circuit based on an output of the infrared ray sensor and an output of the electric power integrating section;

wherein the infrared ray sensor has an amplification factor of the amplifier which is set in such a manner that magnitude of the detection signal is constant until the temperature of the bottom surface of the cooking container reaches a predetermined temperature and the magnitude of the detection signal increases exponentially after the temperature of the bottom surface of the cooking container exceeds the predetermined temperature;

wherein the heating control section determines whether or not an integrated value from the electric power integrating section is less than a first predetermined amount of electric power, when an amount of increase in an output value of the infrared ray sensor on the basis of an output value of the infrared ray sensor at a start of heating with a first amount of heating electric power reaches a first predetermined value, when the integrated value from the electric power integrating section is less than the first predetermined amount of electric power, the heating control section shifts to a first heating control mode for limiting the amount of heating electric power to a second amount of heating electric power lower than the first amount of heating electric power, and when the integrated value from the electric power integrating section is equal to or more than the first predetermined amount of electric power, the heating control section shifts to a second heating control mode for heating with a third amount of heating electric power larger than the second amount of heating electric power.

2. The induction heating cooker according to claim 1, wherein during the first heating control mode, the heating control section repeats control to increase the amount of heating electric power to perform heating with the second amount of heating electric power after lapse of a first predetermined time from stopping or limiting of the heating, and control to stop or limit the heating when the amount of increase in the output value of the infrared ray sensor reaches a second predetermined value.

3. The induction heating cooker according to claim 2, wherein the second predetermined value is equal to or larger than the first predetermined value.

4. The induction heating cooker according to claim 3, wherein during the second heating control mode, the heating control section repeats control to stop the heating when the amount of increase in the output value of the infrared ray sensor reaches a third predetermined value larger than the second predetermined value, and control to perform the heating with the third amount of heating electric power when the amount of increase in the output value of the infrared ray sensor decreases below the third predetermined value.

5. The induction heating cooker according to claim 1, wherein the heating control section shifts from the first heating control mode to the second heating control mode, when the integrated value of the amount of heating electric power within a second predetermined time during a heating operation in the first heating control mode exceeds a second amount of heating electric power.

6. The induction heating cooker according to claim 1, wherein the heating control section shifts to the first heating control mode from the second heating control mode, when a time required for the amount of increase in the output value of the infrared ray sensor to reach the first predetermined value after the start of heating with the first amount of heating electric power is equal to or less than a third predetermined time during a heating operation in the second heating control mode.

7. The induction heating cooker according to claim 1, wherein the infrared ray sensor is placed halfway in a radial direction of the heating coil.

* * * * *